US005463870A

United States Patent [19]

Rieth

[11] Patent Number: 5,463,870

[45] Date of Patent: Nov. 7, 1995

[54] PROCESS AND INSTALLATION FOR THE PRODUCTION OF AT LEAST ONE GAS FROM AIR UNDER PRESSURE

[75] Inventor: Norbert Rieth, Paris, France

[73] Assignee: L'Air Liquide, Societe Anonyme pour l'Etude et l'Exploitation des Procedes Georges Claude, Paris, France

[21] Appl. No.: 300,196

[22] Filed: Aug. 29, 1994

[30] Foreign Application Priority Data

Sep. 1, 1993 [FR] France ..... 93 10418

[51] Int. Cl.[6] ..... F25J 3/02

[52] U.S. Cl. ..... 62/25; 62/38; 62/39; 62/41

[58] Field of Search ..... 62/25, 38, 39, 62/41

[56] References Cited

U.S. PATENT DOCUMENTS 4,303,428 12/1981 Vandenbussche ..... 62/38

5,157,926 10/1992 Guilleminot ..... 62/24

5,222,365 6/1993 Nenov ..... 62/39

FOREIGN PATENT DOCUMENTS 0552747 7/1993 European Pat. Off. .

2674011 9/1992 France .

*Primary Examiner*—Ronald C. Capossela

*Attorney, Agent, or Firm*—Young & Thompson

[57] ABSTRACT

All the entering air is brought to a high pressure and then cooled to an intermediate temperature. At this temperature, a portion of the air is work expanded (in 4) to the medium pressure, and the rest is liquified. The low pressure column operates under a pressure of the order of 1.7 to 5 bars absolute, and its residual gas is expanded in a second turbine (9) after having been reheated to ambient temperature, then further heated (in 7) by heat exchange with the compressed air. Use for the production of impure oxygen under pressure and simultaneously at least one liquid product.

11 Claims, 1 Drawing Sheet

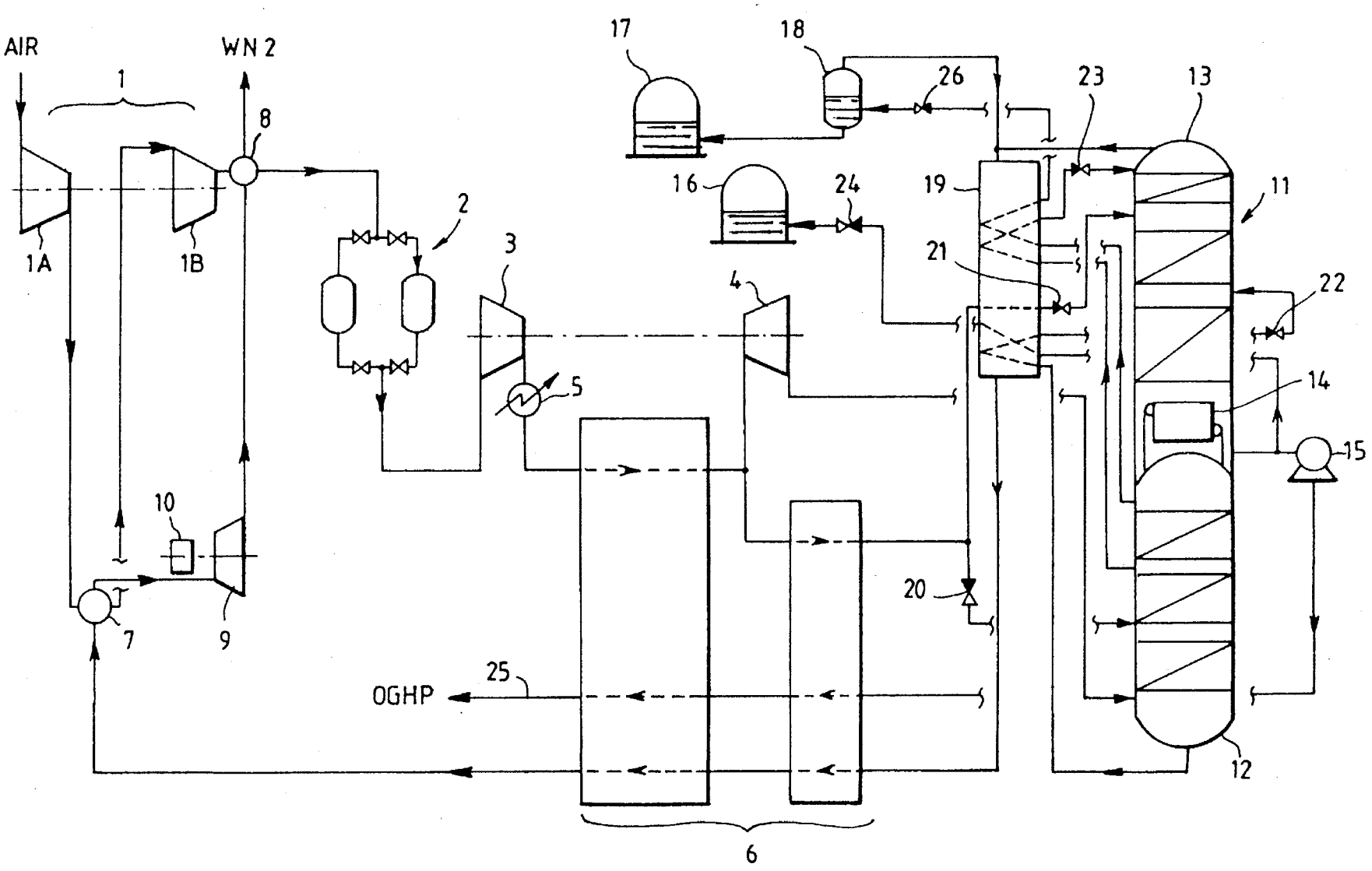
AIR
WN 2
OGHP
1
1A
1B
2
3
4
5
6
7
8
9
10
11
12
13
14
15
16
17
18
19
20
21
22
23
24
25
26

PROCESS AND INSTALLATION FOR THE PRODUCTION OF AT LEAST ONE GAS FROM AIR UNDER PRESSURE

The present invention relates to a process for the production of gaseous oxygen and/or gaseous nitrogen under pressure, of the type in which:

air is distilled in an installation comprising a principal air compressor, a double distillation column comprising a low pressure column operating at a so-called low pressure, and a medium pressure column operating at a so-called medium pressure, and a heat exchange line serving to cool the treated air;

all the air to be distilled is compressed to at least one high air pressure substantially greater than the medium pressure;

the compressed air is cooled to an intermediate temperature, and a portion of it is expanded in a turbine to the medium pressure, before introducing it into the medium pressure column;

the air which is not expanded is liquified, then introduced, after expansion, into the double column; and at least one liquid product withdrawn from the double column is brought to the production pressure, and this liquid product is vaporized by heat exchange with the air.

The pressures in question in the present text are absolute pressures. Moreover, the expression "liquefaction" must be understood in the broad sense, which is to say including pseudo-liquefaction in the case of supercritical pressures.

A process of the above type is described in FR-A-2 674 011. In this process, the gaseous production under pressure is inevitably accompanied by a production of liquid, which is not desirable in all industrial applications.

The invention has for its object to permit a reduction of the production of liquid for a given production capacity of gaseous oxygen and/or nitrogen under pressure, in an economical way as to energy performance.

To this end, the invention has for its object a process of the recited type, characterized in that:

the low pressure column is operated under pressure; and residual gas from the head of the low pressure column is expanded in a second turbine, after having been reheated to the warm end of the heat exchange line.

According to other characteristics:

the residual gas is further heated, before its expansion, by heat exchange with the air from an intermediate stage of the principal compressor;

the expanded residual gas is used to cool the air from the last stage of the principal compressor, before purification of this air from water and carbon dioxide;

the low pressure column is operated under about 1.7 to 5 bars, and the medium pressure column under a corresponding pressure of about 6.5 to 16 bars;

the liquid product is impure oxygen, and purer liquid oxygen is also produced, which is sent to storage.

The invention also has for its object an installation adapted to practice such a process. This installation, of the type comprising a double distillation column comprising a low pressure column operating under a so-called low pressure and producing at its head a residual gas, and a medium pressure column operating under a so-called medium pressure; compression means to bring all of the air to be distilled to at least one high pressure substantially greater than the medium pressure, these means comprising a principal compressor; means for withdrawing from the double column and pumping at least one liquid product resulting from the distillation; a heat exchange line placing in heat exchange relation the air and said liquid product; and an expansion turbine for a portion of this air, the inlet of this turbine being connected to an intermediate point in the heat exchange line and its outlet being connected to the medium pressure column, is characterized in that it comprises a second expansion turbine whose inlet is connected to the outlet of reheating passages of the residual gas of the heat exchange line, at the warm end of this latter.

An example of an embodiment of the invention will now be described with respect to the accompanying drawing, in which the single figure shows schematically an installation according to the invention.

The installation shown in the drawing is adapted to produce gaseous oxygen under a high pressure of about 10 to 100 bars, liquid oxygen and liquid nitrogen.

This installation comprises essentially a principal air compressor 1 comprising itself at least one medium pressure stage 1A and a high pressure stage 1B; an apparatus 2 for purification by adsorption; a blower-turbine assembly comprising a blower 3 and a turbine 4 whose rotors are keyed to the same shaft; an atmospheric or water cooler 5 for the blower; a heat exchange line 6; a first auxiliary heat exchanger 7 and a second auxiliary heat exchanger 8; a second expansion turbine 9 braked by an alternator 10; a double distillation column 11 comprising a medium pressure column 12 and a low pressure column 13 interconnected by a vaporizer-condenser 14 which places in heat exchange relation the nitrogen at the head of column 12 and the liquid oxygen in the base of column 13; a liquid oxygen pump 15; a storage 16 for liquid oxygen at atmospheric pressure; a storage 17 for liquid nitrogen at atmospheric pressure; a phase separator 18; and a sub-cooler 19.

In operation, the column 13 is under pressure of about 1.7 to 5 bars, and column 11 under the corresponding pressure of about 6.5 to 16 bars.

All the air to be distilled is compressed in 1A, cooled in 7, compressed again in 1B, cooled in 8 to +5° to 15° C., purified of water and $CO_2$ in 2 and further compressed in 3 to the high pressure. After pre-cooling in 5 and then partial cooling in 6 to an intermediate temperature T1, a portion of the air under the high pressure continues its cooling in the heat exchange line, is liquified and then divided into two fractions. Each fraction is expanded in a respective expansion valve 20, 21, then introduced into the column 12, 13 respectively.

At temperature T1, the rest of the air under the high pressure leaves the heat exchange line, is work expanded in 4 to the medium pressure and introduced into the base of column 12.

In conventional fashion, "rich liquid" (air enriched in oxygen) withdrawn from the base of column 12 and "poor liquid" (somewhat pure nitrogen) withdrawn from the upper region of this column are, after sub-cooling in 19 and expansion in respective expansion valves 22 and 23, are introduced at an intermediate level and at the head, respectively, of the column 13.

Liquid oxygen is withdrawn from the base of column 13. A fraction goes directly, after sub-cooling in 19 and expansion to atmospheric pressure in an expansion valve 24, to storage 16, while the rest is brought by pump 15 to the desired high production pressure, then vaporized and reheated to ambient temperature in the heat exchange line before being withdrawn through a conduit 25.

Moreover, liquid nitrogen under medium pressure, withdrawn from the head of the column 12, is sub-cooled in 19, expanded to atmospheric pressure in an expansion valve 26, and introduced into the phase separator 18. The liquid phase is sent to storage 17, while the vapor phase is reunited with the impure nitrogen at the head of column 13, then the mixture is reheated in 19 and then in 6.

The residual gas thus reheated to ambient temperature is further heated in 7 and then expanded to about atmospheric pressure in 9, then the expanded gas is reheated in 8. It can then, before being removed from the installation, serve to regenerate the adsorbent in the apparatus 2.

High pressure gaseous oxygen can also be produced, having a given purity, with a reduced specific energy of production, a reduced production ratio of liquid to the capacity for oxygen separation, and an increased extraction output.

The operation under pressure of the column 13 has as a result a reduction in purity of the oxygen product. Thus, the high pressure gaseous oxygen and the liquid oxygen stored in 16 typically have a purity of the order of 95%. However, it is possible to provide several distillation plates between the withdrawal point of liquid oxygen directed on the one hand toward storage in 16, and on the other hand the pump 15, and thereby to produce a fraction, for example 20% of the oxygen, in the form of liquid oxygen of higher purity, typically of 99.5% purity.

The invention is also applicable to the production of gaseous nitrogen under high pressure, brought by a pump (not shown) to the desired high pressure and then vaporized in the heat exchange line, and/or to the production of oxygen and/or nitrogen under several pressures, by using several high pressures of air. Moreover, the vaporization of the liquid or liquids can be effected in a manner which is not associated with the liquefaction of air, with an elbow of liquefaction of the air below the vaporization temperature of the oxygen, or in a manner concomitant with this liquefaction.

I claim:

1. In a process for the production of at least one of gaseous oxygen and gaseous nitrogen under pressure, wherein air is distilled in an installation comprising a principal air compressor, a double distillation column comprising a low pressure column operating under a low pressure, and a medium pressure column operating under a medium pressure, and a heat exchange line serving to cool the treated air; all the air to be distilled is compressed to at least one high air pressure substantially greater than the medium pressure; the compressed air is cooled to an intermediate temperature, and a portion thereof is expanded in a turbine to the medium pressure, before introducing it into the medium pressure column; the unexpanded air is liquified, and then introduced after expansion into the double column; and a liquid product is withdrawn from the double column and a portion of said liquid product is brought to the production pressure, and this portion of the liquid product is vaporized by heat exchange with the air; the improvement comprising operating the low pressure column under a pressure higher than atmospheric pressure; and expanding residual gas from the head of the low pressure column in a second turbine, after having been reheated to the warm end of the heat exchange line.

2. A process according to claim 1, wherein the residual gas is further heated, before its expansion, by heat exchange with the air from an intermediate stage of the principal compressor.

3. A process according to claim 1, wherein the residual expanded gas is used to cool the air from the last stage of the principal compressor, before purifying this air of water and carbon dioxide.

4. A process according to claim 1, wherein the low pressure column is operated under about 1.7 to 5 bars, and the medium pressure column under a pressure of about 6.5 to 16 bars.

5. A process according to claim 1, wherein said liquid product is impure oxygen, and there is also produced purer oxygen which is sent to a storage.

6. A process according to claim 1, wherein said residual gas is warmed to ambient temperature in said warm end.

7. In an installation for the production of at least one of gaseous oxygen and gaseous nitrogen under pressure, comprising a double distillation column for air comprising a low pressure column operating under a low pressure and producing at its head a residual gas, and a medium pressure column operating under a medium pressure; compression means to bring all the air to be distilled to at least one high pressure substantially greater than the medium pressure, said means comprising a principal compressor; means for withdrawing a liquid product from the double column and for pumping a portion of said liquid product to the production pressure; the heat exchange line placing in heat exchange relation the air and said portion of said liquid product; and a turbine for the expansion of a portion of this air, the inlet of said turbine being connected to an intermediate point of the heat exchange line and its outlet being connected to the medium pressure column; the improvement wherein the installation further comprises a second expansion turbine whose inlet is connected to the outlet of reheating passages of the residual gas of the heat exchange line, at the warm end of said heat exchange line.

8. An installation according to claim 7, which further comprises a heat exchanger placing in heat exchange relation the gas circulating between said outlet and the second turbine and the air from an intermediate stage of the principal compressor.

9. An installation according to claim 7, which further comprises a second heat exchanger placing in heat exchange relation the gas from the second turbine and the air from the first stage of the principal compressor.

10. An installation according to claim 7, wherein the low pressure column comprises a distillation section between a lower withdrawal of liquid oxygen destined to be stored and a liquid oxygen withdrawal connected to the inlet of the pump.

11. An installation according to claim 7, wherein said outlet of said reheating passages is at ambient temperature.

* * * * *